US006830472B1

(12) United States Patent
Wu

(10) Patent No.: US 6,830,472 B1
(45) Date of Patent: Dec. 14, 2004

(54) CABLE END CONNECTOR ASSEMBLY HAVING LOCKING MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/660,315

(22) Filed: Sep. 10, 2003

(51) Int. Cl.[7] ..... H01R 13/627
(52) U.S. Cl. ..... 439/358; 439/352
(58) Field of Search ..... 439/352, 357, 439/358, 108, 607, 906, 939, 610

(56) References Cited

U.S. PATENT DOCUMENTS 5,112,243 A * 5/1992 Chow et al. ..... 439/352
6,431,887 B1 * 8/2002 Yeomans et al. ..... 439/108
6,565,383 B1 5/2003 Wu
6,585,536 B1 7/2003 Wu
6,585,537 B1 7/2003 Lee

* cited by examiner

*Primary Examiner*—Alex Gilman
(74) *Attorney, Agent, or Firm*—Wei Te Chung

(57) ABSTRACT

A cable end connector assembly (10) for mating with a complementary connector (20) includes an insulative housing (12), a plurality of contacts (130) received in the insulative housing, a spacer (13) mounted to a rear end of the insulative housing, a cable (14) including a number of conductors (140) electrically connecting with corresponding contacts, a cover (15) over-molded with the insulative housing and the cable, and a locking member (16). The locking member includes a retaining section (163) secured with the cover, a main section (160) extending forwardly from the retaining section, and a locking section (161) extending forwardly from the main section. The locking section (161) has a pair of resilient tabs (1611) resiliently abutting against the cover and a pair of latch portions (1610) for locking with corresponding portions of the complementary connector.

13 Claims, 9 Drawing Sheets

CABLE END CONNECTOR ASSEMBLY HAVING LOCKING MEMBER

CROSS-REFERENCE TO RELATED APPLICATIONS

This application is related to another application entitled "CABLE END CONNECTOR ASSEMBLY HAVING LOCKING MEMBER", which is invented by the same inventor and assigned to the same assignee as this application and which is hereby fully incorporated by reference.

BACKGROUND OF THE INVENTION

1. Field of the Invention

The present invention relates to a cable end connector assembly, and particularly to a cable end connector assembly having a locking member for locking with a complementary connector.

2. Description of Related Art

There exists in the art an electrical connector known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively tiny in configuration. It is desirable for the Serial ATA connector to have latch means for providing a reliable mechanical and electrical connection with a complementary connector. U.S. Pat. Nos. 6,565,383 and 6,585,536, having the same inventor and the same assignee with the present invention, each disclose a Serial ATA connector equipped with a locking member for locking with a complementary connector. The locking member comprises a middle portion retained on a connector housing, a pushing portion extending rearwardly from the middle portion, and a locking portion extending forwardly from the middle portion for locking/releasing the Serial ATA connector with/from the complementary connector.

However, since the middle portion of the locking member is retained on the connector housing, the distance between a locking position and a releasing position of the locking portion is relatively small, thereby adversely affecting the engagement and disengagement between the Serial ATA connector and the complementary connector.

Hence, a cable end connector assembly having an improved locking member is desired.

SUMMARY OF THE INVENTION

An object of the present invention is to provide a cable end connector assembly having an improved locking member for locking the cable end connector assembly with a complementary connector.

To achieve the above object, a cable end connector assembly in accordance with the present invention comprises an insulative housing, a plurality of contacts received in the insulative housing, a spacer mounted to a rear end of the insulative housing, a cable comprising a plurality of conductors electrically connecting with corresponding contacts, a cover over-molded with the insulative housing and the cable, and a locking member. The locking member comprises a retaining section secured with the cover, a main section extending forwardly from the retaining section, and a locking section extending forwardly from the main section. The locking section has a pair of resilient tabs resiliently abutting against the cover and a pair of latch portions for locking with corresponding portions of the complementary connector, Other objects, advantages and novel features of the invention will become more apparent from the following detailed description when taken in conjunction with the accompanying drawings.

DETAILED DESCRIPTION OF THE INVENTION

Figure 1:
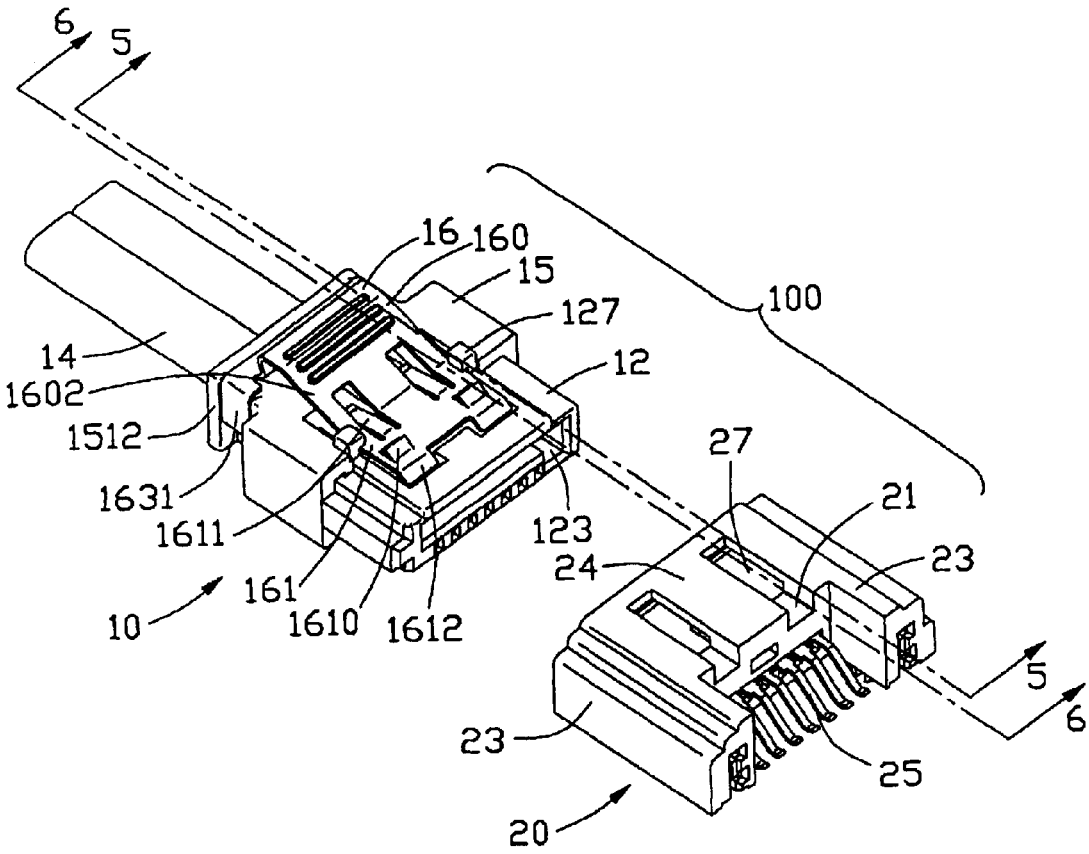
FIG. 1 is a perspective view of an electrical connector assembly, showing a cable end connector assembly in accordance with the present invention and a complementary connector.
Figure 2:
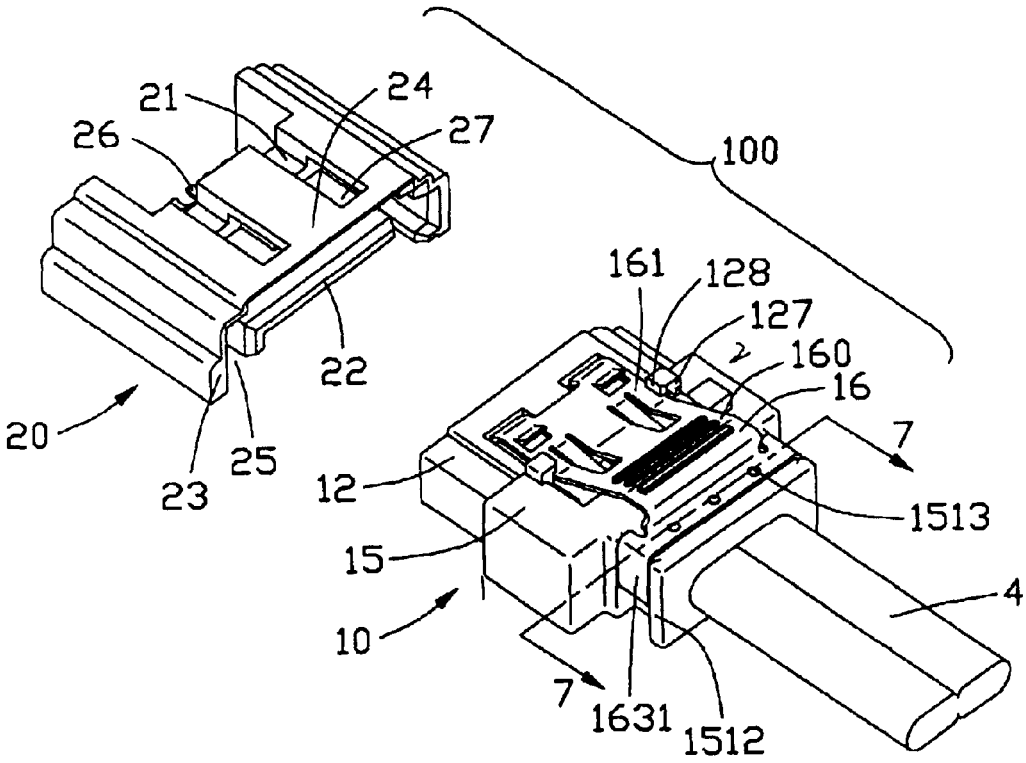
FIG. 2 is a view similar to FIG. 1, but taken from a different aspect.

Referring to FIGS. 1 and 2, an electrical connector assembly 100 comprises a cable end connector assembly 10 in accordance with the present invention and a complementary connector 20. In a preferred embodiment, the cable end connector assembly 10 and the complementary connector 20 are typical Serial ATA connectors. However, in alternative embodiments, the electrical connectors could be provided as other types.

Figure 3:
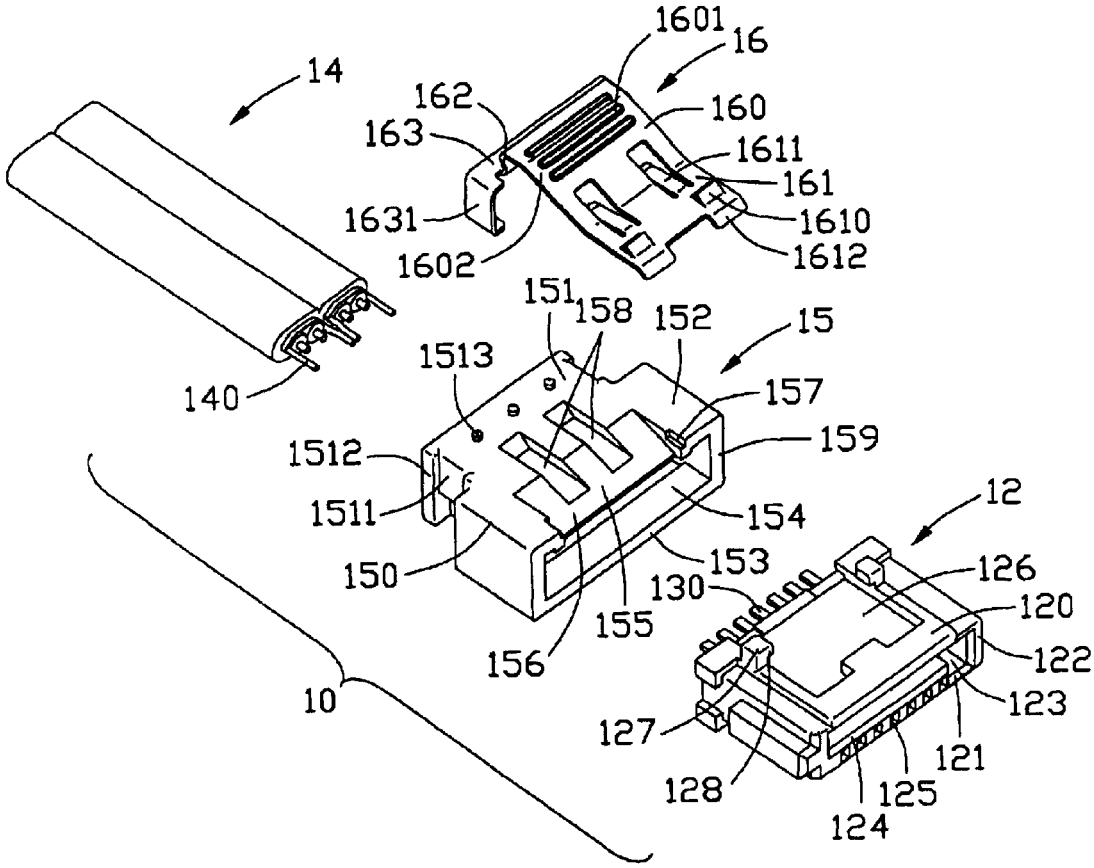
FIG. 3 is an exploded perspective view of the cable end connector assembly of FIG. 1.
Figure 4:
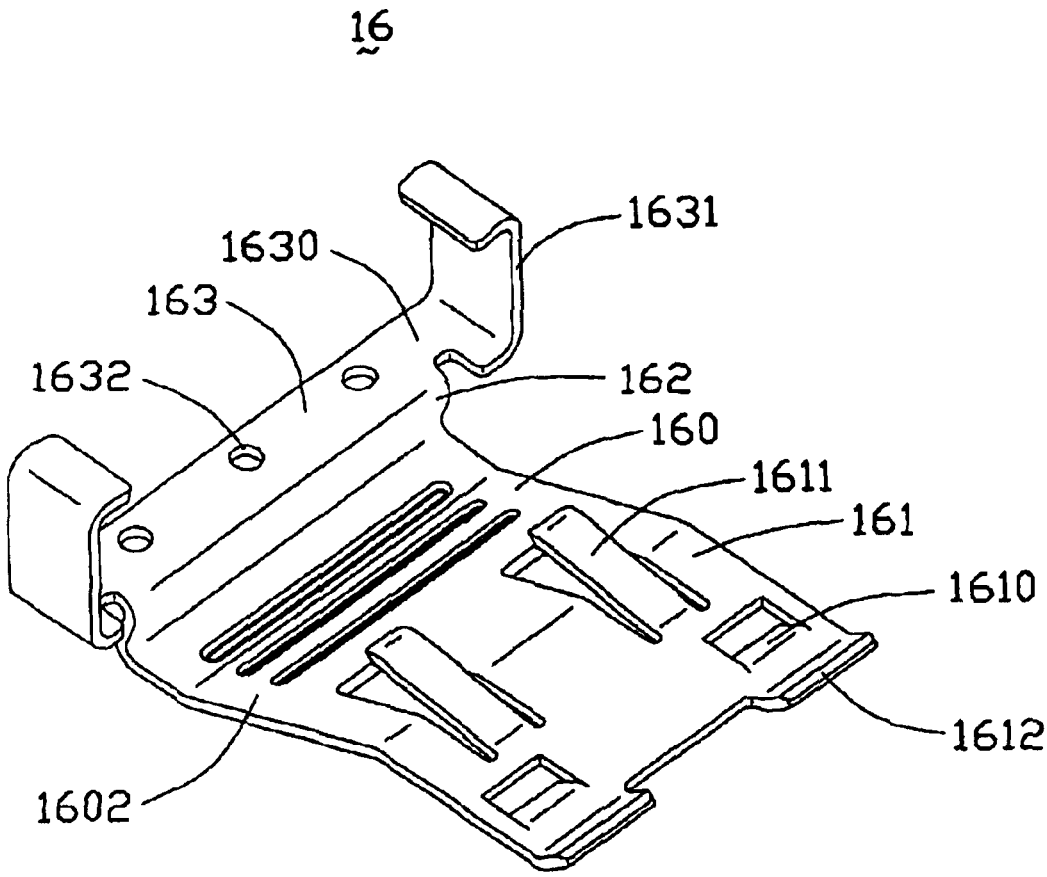
FIG. 4 is an enlarged perspective view of a locking member of the cable end connector assembly.
Figure 5:
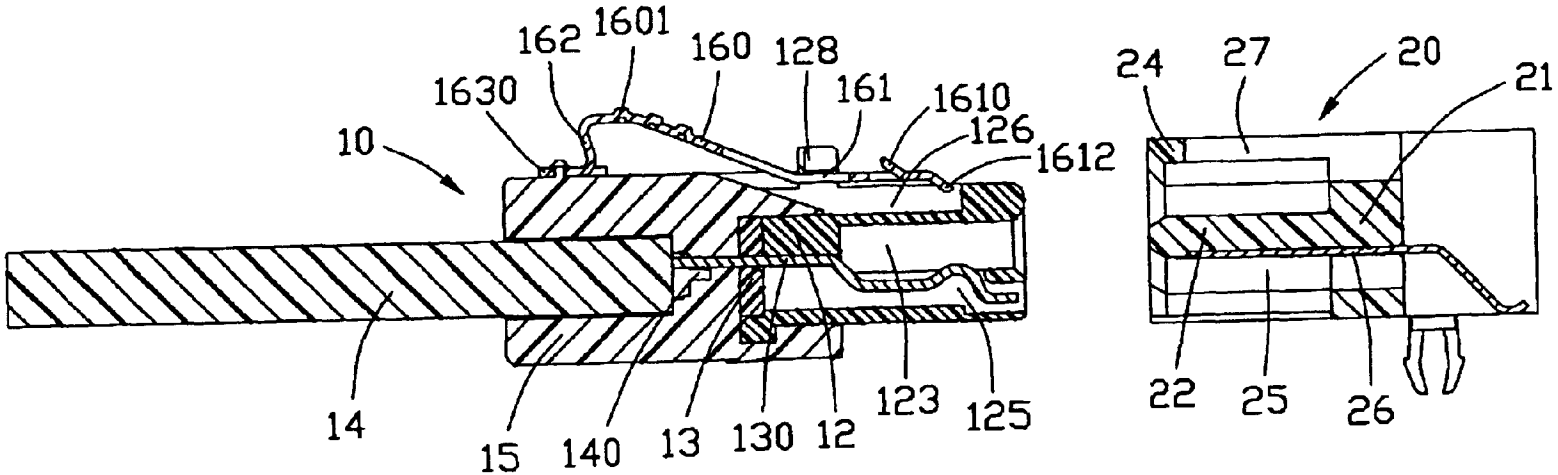
FIG. 5 is a cross-sectional view taken along line 5—5 of FIG 1.
Figure 6:
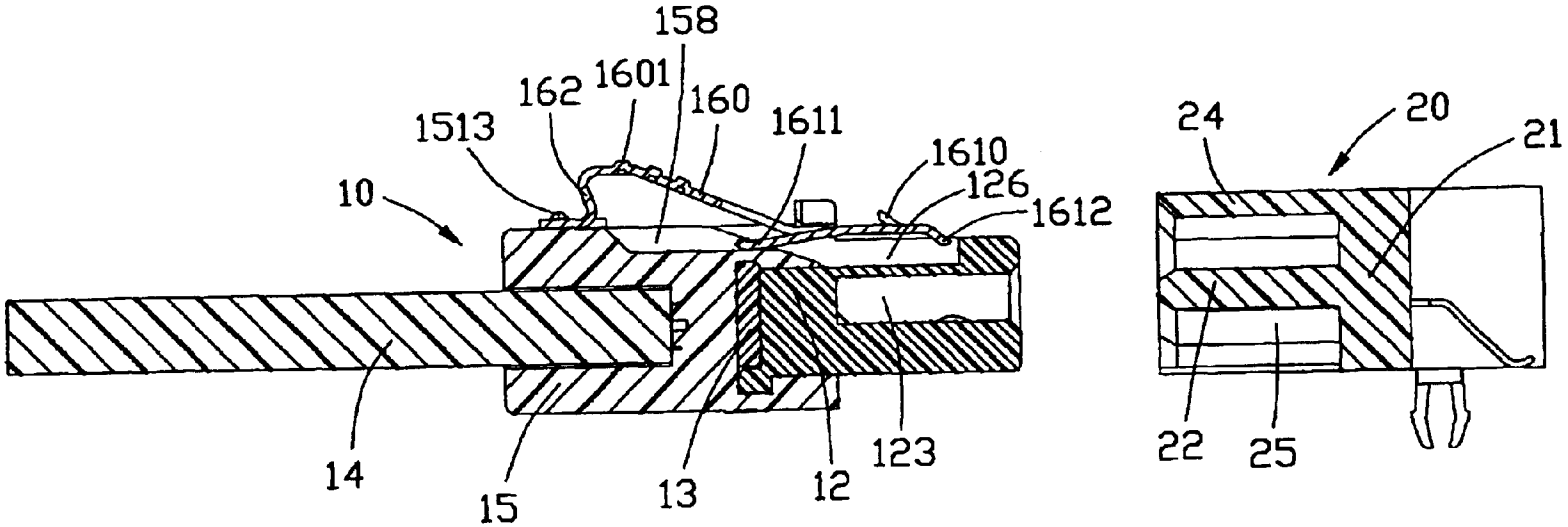
FIG. 6 is a cross-sectional view taken along line 6—6 of FIG. 1.
Figure 7:
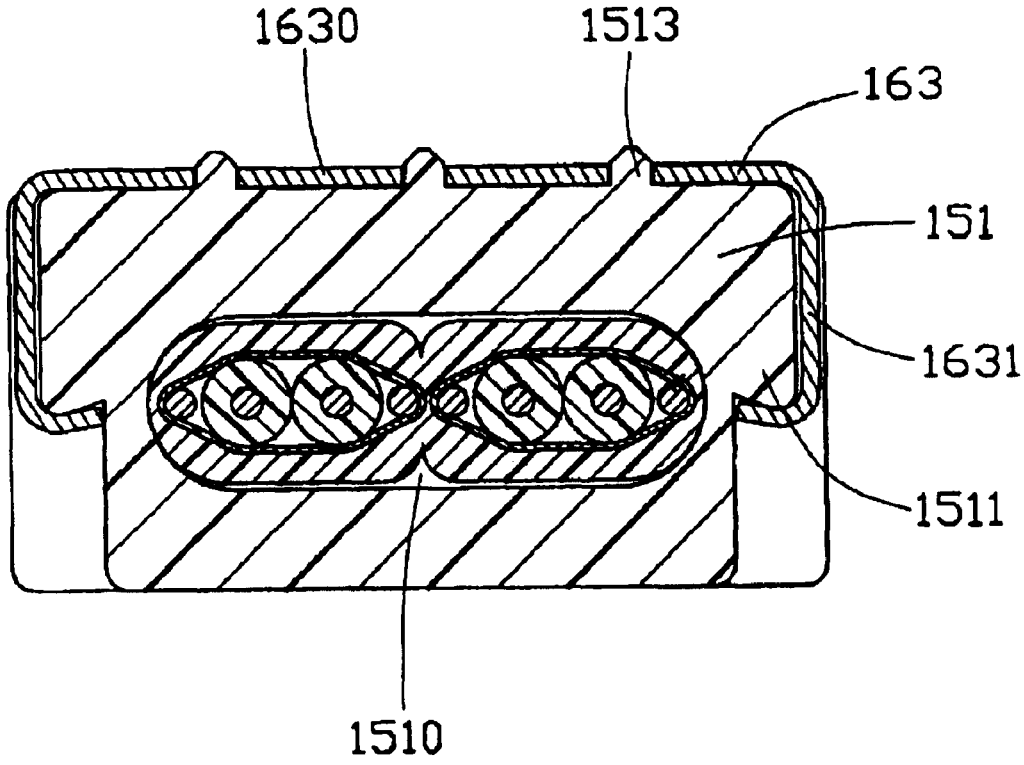
FIG. 7 is a cross-sectional view taken along line 7—7 of FIG. 2.

Referring to FIGS. 3 and 4 in conjunction with FIGS. 5–7, the cable end connector assembly 10 comprises an insulative housing 12, a plurality of contacts 130, a spacer 13, a cable 14, a cover 15, and a locking member 16. The insulative housing 12 comprises an upper wall 120, a lower wall 121 opposite to the upper wall 120, and a pair of sidewalls 122 connecting with the upper and the lower walls 120, 121. An L-shaped receiving space 123 is defined between the upper and the lower walls 120, 121. A block 124 is formed on the lower wall 121 and protrudes into the receiving space 123. The block 124 defines a plurality of passageways 125 extending therethrough. The upper wall 120 defines a depression 126 on an upper surface thereof. A pair of retention portions 127 protrude upwardly from the upper surface of the upper wall 120 and at opposite sides of the depression 126. A stopper 128 extends inwardly from each retention portion 127.

The contacts 130 are received in the passageways 125 of the insulative housing 12 with tail portions (not labelled) thereof extending rearwardly beyond a rear face of the insulative housing 12. The spacer 13 is mounted to a rear end of the insulative housing 12 and defines a plurality of through holes (not labelled) for allowing the tail portions of the contacts 130 extending therethrough. The spacer 13 can prevent plastic from entering into the passageways 125 of the insulative housing 12 during the molding of the cover 15. The contacts 130 and the spacer 13 can be integrally formed before mounting to the insulative housing 12, if desired.

The cable 14 comprises a plurality of conductors 140 exposed outside.

The cover 15 is over-molded with the insulative housing 12 and the cable 14 and comprises a rectangular body portion 150 and a rear portion 151 extending rearwardly from the body potion 150. The body portion 150 comprises an upper plate 152, a lower plate 153 opposite to the upper plate 152, and a pair of side plates 159 connecting with the upper and the lower plates 152, 153. A receiving cavity 154 is defined between the upper and the lower plates 152, 153 for receiving a rear end of the insulative housing 12. A recess 155 is defined in the front end of the upper plate 152. The recess 155 has an inclined bottom surface 156. A pair of cutouts 157 are defined in opposite inner sides of the recess 155 and adjacent to the front end of the upper plate 152. The upper plate 152 defines a pair of channels 158 communicating with the recess 155. The rear portion 151 defines a hole 1510 communicating with the receiving cavity 154 for receiving the cable 14. Each side of the rear portion 151 is formed with a locking portion 1511 and a bar 1512. The bar 1512 is located behind the locking portion 1511 and protrudes laterally. A plurality of embossments 1513 are formed on an upper side of the rear portion 151.

The locking member 16 is stamped and formed from a metallic plate and comprises a retaining section 163, a main section 160, and a locking section 161. The retaining section 163 comprises a main body 1630 and a pair of securing portions 1631 extending downwardly from opposite ends of the main body 1630. The main body 1630 defines a plurality of apertures 1632 therein. The main section 160 comprises a connecting portion 162 extending upwardly from the main body 1630 of the retaining section 163 and an inclined portion 1602 extending forwardly and downwardly from a top end of the connecting portion 162. The inclined portion 1602 is formed with a plurality of ribs 1601 for facilitating handling. The locking section 161 extends forwardly from a front end of the inclined portion 1602 and comprises a pair of latch portions 1610 extending upwardly and rearwardly therefrom, a pair of resilient tabs 1611 extending rearwardly and downwardly therefrom, and a pair of forwardly and downwardly extending guiding portions 1612 at a front end thereof.

Referring to FIGS. 1, 2 and 5–7, in assembly, the conductors 140 of the cable 14 are first soldered to the contacts 130, which are exposed outside the insulative housing 12. The cover 15 is over-molded with the rear end of the insulative housing 12 with the front end of the cable 14 received in the through hole 1510. The retention portions 127 of the insulative housing 12 are received in the cutouts 157 of the cover 15. The recess 155 of the cover 15 communicates with the depression 126 of the insulative housing 12. The locking member 16 is then assembled to the insulative housing 12 and the cover 15. The retaining section 163 partially encloses the rear portion 151 of the cover 15 with distal ends of the securing portions 1631 bent inwardly and locked with the locking portions 1511. Rear edges of the securing portions 1613 abut against the bars 1512 and the embossments 1513 are received in the apertures 1632 to prevent the locking member 16 from moving rearwardly when the cable end connector assembly 10 mates with the complementary connector 20. The stoppers 128 of the retention portions 127 press against opposite side edges of the locking section 161 to deflect the locking section 161 toward the depression 126. The resilient tabs 1611 are received in the channels 158 of the cover 15 and abut against bottom surfaces of the channels 158. The front end of the inclined portion 1602 and the locking section 161 are downwardly deflectable into the recess 155 and the depression 126, respectively.

Referring to FIGS. 1 and 2 in conjunction with FIGS. 5 and 6, the complementary connector 20 comprises a base portion 21, a tongue portion 22 extending forwardly from a middle portion of the base portion 21, a pair of arm portions 23 extending from opposite ends of the base portion 21 in a mating direction of the complementary connector 20, and a protect portion 24 extending forwardly from an upper portion of the base portion 21 and connecting with upper sides of the pair of the arm portions 23. The arm portions 23 and the protect portion 24 define a mating space 25. A plurality of terminals 26 are received in the tongue portion 22 and each terminal 26 has a tail portion extending beyond a rear face of the base portion 21 for connecting to a printed circuit board (not shown) on which the complementary connector 20 is mounted. The protect portion 24 defines a pair of engaging openings 27 extending therealong and communicating with the mating space 25.

Figure 8:
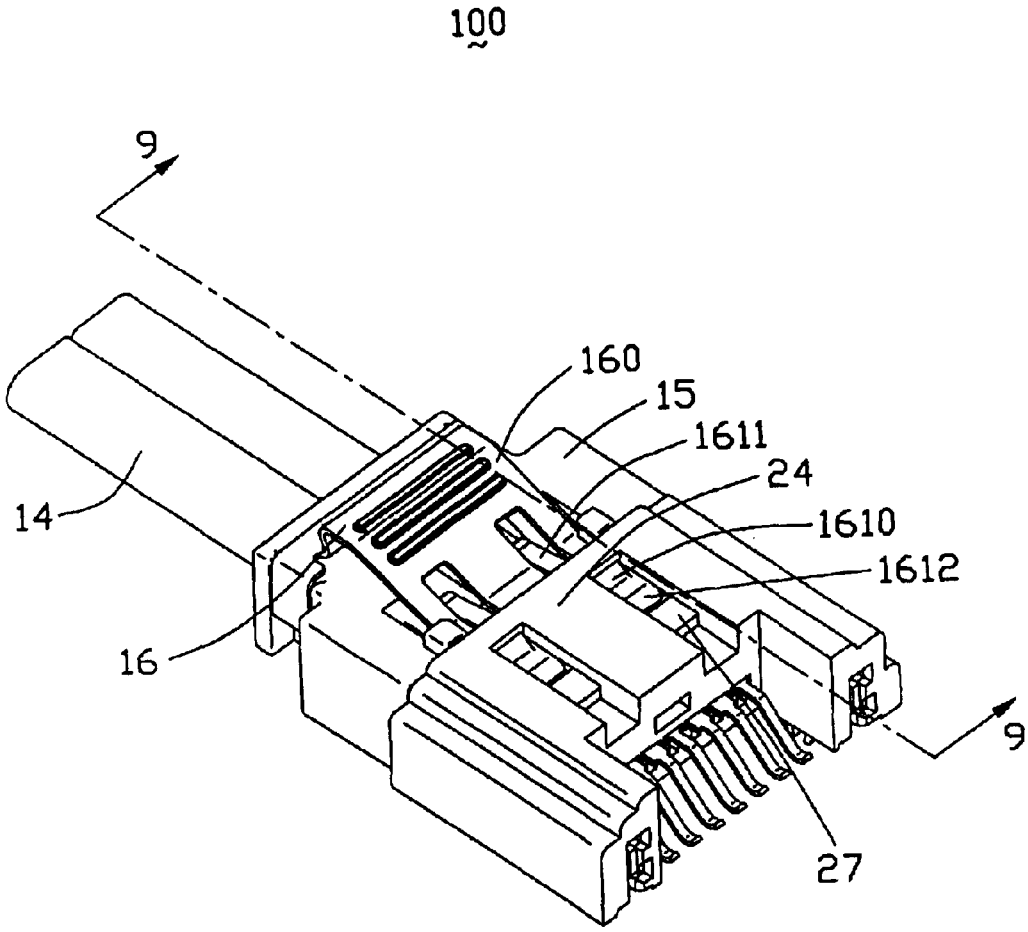
FIG. 8 is an assembled view of the cable end connector assembly and the complementary connector of FIG. 1.
Figure 9:
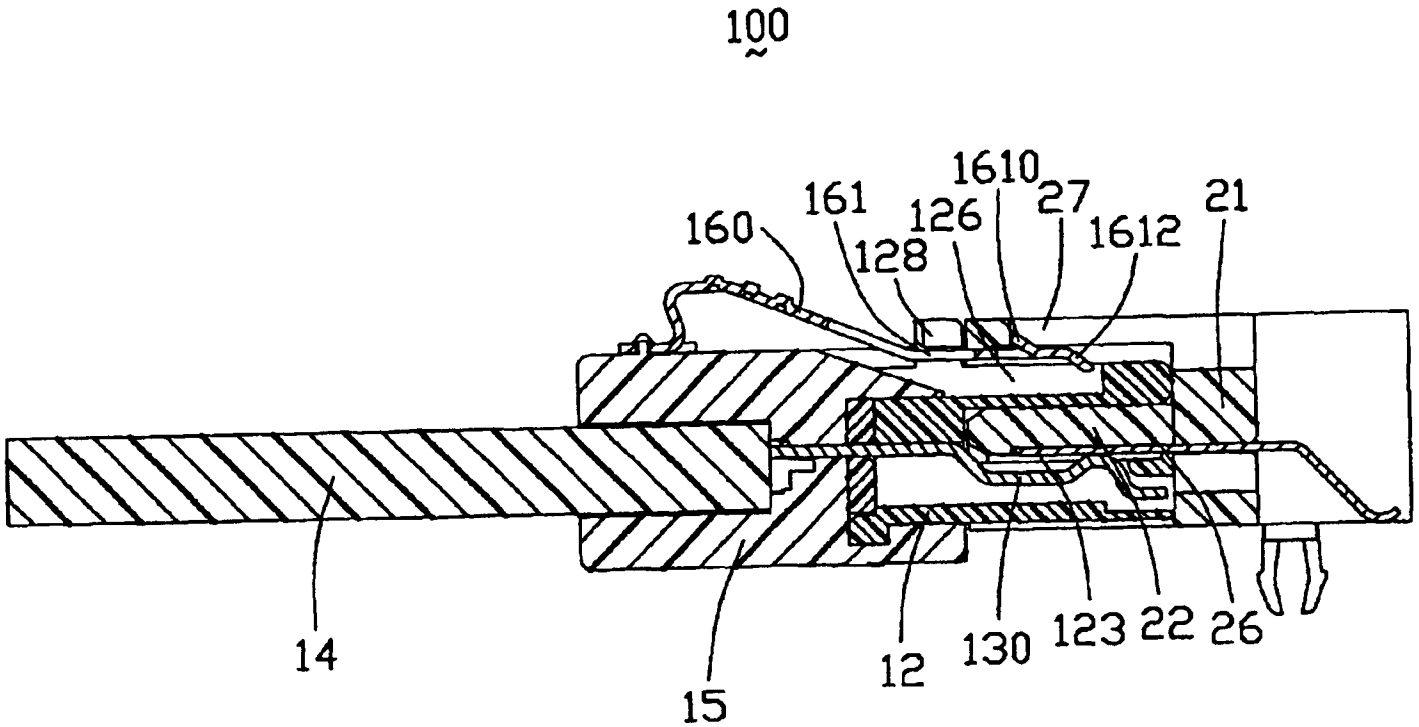
FIG. 9 is a cross-sectional view taken along line 9—9 of FIG. 8.

Referring to FIGS. 8 and 9, when the cable end connector assembly 10 is to be mated with the complementary connector 20, a pressing force is exerted on the main section 160 of the locking member 16 to downwardly deflect the resilient tabs 1611 of the locking section 161, a front end of the cable end connector assembly 10 is inserted into the mating space 25 of the complementary connector 20 and the tongue portion 22 of the complementary connector 20 is received in the receiving space 123 of the cable end connector assembly 10. At the same time, the terminals 26 of the complementary connector 20 electrically connect with the contacts 130 of the cable end connector assembly 10. The guiding portions 1612 guide the insertion of the locking section 161 into the mating space 25 of the complementary connector 20. Once the pressing force is released, the main section 160 and the resilient tabs 1611 restore to their original configurations due to their own elasticity. The latch portions 1610 of the locking member 16 are locked in the corresponding engaging openings 27, thereby establishing a reliable engagement between the cable end connector assembly 10 and the complementary connector 20. When the cable end connector assembly 10 is to be disengaged from the complementary connector 20, a contrary operating procedure is applied.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principle of the invention to the full extent indicated by the broad general meaning of the terms in which the appended claims are expressed.

What is claimed is:

1. A cable end connector assembly for mating with a complementary, comprising:

an insulative housing;

a plurality of contacts received in the insulative housing;

a cable comprising a plurality of conductors electrically connecting with corresponding contacts;

a cover enclosing a rear end of the insulative housing; and a locking member comprising a retaining section secured with the cover, a main section extending forwardly from the retaining section, and a locking section extending forwardly from the main section and having a latch portion adapted for locking with the complementary connector, the insulative housing comprising a retention portion pre-stressing the locking section wherein the locking section is movable with the main secion to deflect toward the cover and the insulative housing, wherein the insulative housing defines a depression and the cover defines a recess communicating with the depression, the locking section and a front end of the main section are respectively deflected into the depression and the recess when the locking secdon is mating with the complementary connector, wherein the insulative housing comprises another retention portion, each of the two retention portions having a stopper ovtr the depression and pressing a side edge of the locking section.

2. The cable end connector assembly as claimed in claim 1, wherein the cover defines a channel therein, and wherein the locking section comprises a resilient tab resiliently abutting against of the channel.

3. The cable end connector assembly as claimed in claim 1, wherein the main section is formed with a plurality of ribs thereon.

4. The cable end connector assembly as claimed in claim 1, wherein the locking section of the locking member comprises a forwardly and downwardly extending guiding portion at a front end thereof.

5. The cable end connector assembly as claimed in claim 1, wherein the retaining section partially encloses a rear portion of the cover and comprises a main body and a pair of securing portions extending from opposite ends of the main body.

6. The cable end connector assembly as claimed in claim 5, wherein the main section of the locking member comprises a connecting portion extending upwardly from the main body of the retaining section, and an inclined portion extending forwardly and downwardly from a top end of the connecting portion.

7. The cable end connector assembly as claimed in claim 5, wherein the rear portion of the locking member comprises a connecting portion extending upwardly from the main body of the retaining section, and an inclined portion extending forwardly and downwardly from a top end of the connecting portion.

8. The cable end connector assembly as claimed in claim 7; wherein the rear portion of the cover is formed with a pair of bars behind corresponding locking portions and protruding sidewardly, and wherein rear edges of the securing portions abut against corresponding bars.

9. The cable end connector assembly as claimed in claim 5, wherein the rear portion of the cover is formed with an embossment on the side thereof, and wherein the main body of the retaining portion defines an aperture receiving the embossment.

10. An electrical connector assembly comprising:

a cable end connector assembly comprising an insulative housing defining a receiving space, a plurality of contacts mounted in the insulative housing, a cable comprising a plurality of conductors electrically connecting with corresponding contacts, a cover enclosing a rear end of the insulative housing, and a locking member mounted on an upper side of the cover and the insulative housing, the locking member comprising a resilient tab extending therefrom and abutting against the upper side of the cover and the insulative housing and a latch portion extending upwardly therefrom, the locking member being deflectable toward the upper side of the cover and the insulative housing; and a complementary connector comprising a base portion, a tongue portion and a protect portion respectively extending forwardly from a middle and an upper portions of the base portion, and a plurality of terminals received in the tongue portion, the tongue portion being received in the receiving space of the cable end connector assembly with the terminals electrically connecting with the contacts of the cable end connector assembly, the protect portion defining an engaging opening receiving the latch portion of the locking member for providing a mechanical connection between the cable end connector assembly and the complementary connector.

11. The electrical connector assembly as claimed in claim 10, wherein the complementary connector comprises a pair of arm portions extending from opposite ends of the base portion in a mating direction of the complementary connector, the arm portions connecting with the protect portion at upper ends thereof to define a mating space receiving a front end of the cable end connector assembly.

12. An electrical connector assembly comprising:

a cable end connector including:

a first insulative housing with a plurality of first contacts therein;

a cable including a plurality of conductors connected to the corresponding first contacts, respectively;

a metallic locking member attached to the first housing with at least a fulcrum at a rear end, a latch portion at a front end and a main pressing section between said fulcrum and said latch portion;

an upper wall of the first housing defining a depression receiving the moveable locking member therein; and a complementary connector adapted to be mounted to a printed circuit board and mate with the cable end connector, said complementary connector including:

a second insulative housing with a forward mating tongue;

a plurality of second contacts disposed in the second housing;

a protection portion spatially located above the mating tongue in a vertical direction with an engaging opening therein; wherein when the cable end connector and the complementary connector are mated with each other, the first contacts and the second contacts are mechanically and electrically engaged with each other and the upper wall of the cable end connector is received between the mating tongue and the protection portion of the complementary connector under a condition that the latch portion of the locking member is latchably engaged in the engaging opening.

13. The assembly as claimed in claim 12, wherein said engaging opening is exposed to an exterior along said vertical direction.

* * * * *